US006676468B2

(12) United States Patent
Ishiguro et al.

(10) Patent No.: US 6,676,468 B2
(45) Date of Patent: Jan. 13, 2004

(54) METHOD OF PRODUCING A SPARK PLUG

(75) Inventors: Hiroya Ishiguro, Kariya (JP); Kozo Takamura, Nagoya (JP); Toshikazu Shimizu, Okazaki (JP)

(73) Assignee: Denso Corporation, Kariya (JP)

( * ) Notice: Subject to any disclaimer, the term of this patent is extended or adjusted under 35 U.S.C. 154(b) by 68 days.

(21) Appl. No.: 09/985,356

(22) Filed: Nov. 2, 2001

(65) Prior Publication Data

US 2002/0055318 A1 May 9, 2002

(30) Foreign Application Priority Data

Nov. 6, 2000 (JP) ..... 2000-337835

(51) Int. Cl.[7] ..... H01T 21/02
(52) U.S. Cl. ..... 445/7; 313/141; 313/142
(58) Field of Search ..... 445/7, 49; 313/141, 313/142; 228/160, 155, 159

(56) References Cited

U.S. PATENT DOCUMENTS 4,465,952 A * 8/1984 Sato et al. ..... 313/141
4,786,267 A * 11/1988 Toya et al. ..... 445/7
4,826,462 A * 5/1989 Lenk ..... 445/7
4,853,582 A * 8/1989 Sato et al. ..... 313/141
4,963,112 A * 10/1990 Benedikt et al. ..... 445/7
5,107,168 A 4/1992 Friedrich et al.
5,461,210 A * 10/1995 Matsutani et al. ..... 445/7
5,502,351 A * 3/1996 Katoh et al. ..... 313/141
5,527,198 A * 6/1996 Chiu et al. ..... 445/7
5,556,315 A * 9/1996 Kagawa ..... 445/7
5,811,915 A * 9/1998 Abe et al. ..... 445/7
6,093,071 A * 7/2000 Osamura et al. ..... 445/7
6,094,000 A * 7/2000 Osamura et al. ..... 313/141
6,215,234 B1 * 4/2001 Abe et al. ..... 445/7
6,346,766 B1 * 2/2002 Kanao et al. ..... 445/7
6,362,562 B1 * 3/2002 Rossi ..... 445/7
6,412,465 B1 * 7/2002 Lykowski et al. ..... 445/7
6,523,515 B2 * 2/2003 Kanao ..... 445/7
6,533,628 B1 * 3/2003 Matsutani ..... 445/7
6,533,629 B1 * 3/2003 Boehler et al. ..... 445/7

FOREIGN PATENT DOCUMENTS

JP A-3-34283 2/1991

* cited by examiner

*Primary Examiner*—Dean A. Reichard
*Assistant Examiner*—Angel R. Estrada
(74) *Attorney, Agent, or Firm*—Posz & Bethards, PLC

(57) ABSTRACT

In producing a spark plug including a central electrode having a first chip including noble metal and an earth electrode having a second chip including the noble metal, a spark gap being disposed between the first and second chips, a chip including the noble metal. The chip is welded to an end of the central electrode and to an end of the earth electrode. The welded chip is cut to form the first and second chips and the spark gap.

40 Claims, 16 Drawing Sheets

CUT

METHOD OF PRODUCING A SPARK PLUG

BACKEARTH OF THE INVENTION

1. Field of the Invention

This invention relates to a method of producing a spark plug including a central electrode having a first chip including a noble metal and an earth electrode having a second chip including the noble metal to have a gap between said first and second chips.

2. Description of the Prior Art

Spark plugs using a noble metal chip at the end of their central electrode to provide a spark gap are known. The use of a noble metal provides a long effective life. U.S. Pat. Ser. No. 5,107,168 discloses a spark plug in which a platinum or platinum alloy attachment member is attached to its central electrode to provide a longer effective life.

In such a prior art spark plug, the bonding process of the noble metal chips to the central electrode and the earth electrode is complicated because positioning of the noble metal chips is required for respective electrodes. Moreover, if there are a plurality of earth electrodes, the welding operation is more complicated because several noble chips must be positioned and bonded.

SUMMARY OF THE INVENTION

The aim of the present invention is to provide a superior method of producing a spark plug.

According to the present invention, a first aspect of the present invention provides a method of producing a spark plug including a central electrode having a first chip including noble metal and an earth electrode having a second chip including said noble metal, a spark gap being disposed between said first and second chips, comprising the steps of: preparing a chip including said noble metal; welding said chip to an end of said central electrode and to an end of said earth electrode; and cutting said welded chip to form said first and second chips and said spark gap.

According to the present invention, a second aspect of the present invention provides a method of producing a spark plug including a central electrode having a first chip including noble metal and a plurality of earth electrodes, each having a second chip including said noble metal, spark gaps being provided between said first chip and second chips, comprising the steps of: preparing a chip including said noble metal; welding said chip to an end of said central electrode and to ends of said earth electrodes; and cutting said welded chip to form said first chip and said second chips with said spark gaps.

According to the present invention, a third aspect of the present invention provides a method of producing a spark plug including a central electrode having a first chip including noble metal and a tubular metal housing with an earth electrode having a second chip including said noble metal, a spark gap being provided between said first and second chips, comprising the steps of: preparing a chip including said noble metal having a hole of which opening size corresponds to a cross-sectional size of an end of said central electrode, an outline size of said chip corresponding to distance between said end of said central electrode and an end of said earth electrode; fitting said end of said central electrode to said hole; placing said earth electrode on an end of said tubular metal housing such that said chip is supported by contact with said end of said earth electrode; welding said fitted chip to said end of said central electrode and to said end of said earth electrode; and cutting said welded chip to form said first and second chips and said spark gap.

According to the present invention, a fourth aspect of the present invention provides a method of producing a spark plug including a central electrode having a first chip including noble metal and a tubular metal housing having a plurality of earth electrodes, each earth electrode having a second chip including said noble metal, spark gaps being disposed between said first and second chips, comprising the steps of: preparing a chip including said noble metal; welding said chip to an end of said central electrode; placing a unit member including a plurality of said earth electrodes on one end of said housing such that ends of said earth electrodes are supported by contact with a surface of said chip to position said unit member; welding said unit member to said housing; welding ends of said earth electrodes to said chip; and cutting said welded chip to form said first chip and said second chips with said spark gaps.

According to the present invention, a fifth aspect of the present invention provides a method of producing a spark plug including a central electrode having a first chip including noble metal and having a circular plate shape and an earth electrode having a second chip including said noble metal and having a ring shape surrounding said first chip, a spark gap being disposed between said first and second chips, comprising the steps of: preparing a circular plate chip including said noble metal; welding said circular plate chip to an end of said central electrode and to an end of said earth electrode; and cutting said welded chip to form said first and second chips and said spark gap.

In the fifth aspect, said earth electrode is formed to have one open dome.

In the fifth aspect, said earth electrode is formed to have a plurality of earth electrodes which are arranged to surround said first chip.

In the first, second, fourth, and fifth aspects, said chip has a positioning hole, said method further comprising the step of inserting said end of said central electrode into said positioning hole before welding.

In the first, second, fourth, and fifth aspects, an opening size of said hole is determined in accordance with a cross-sectional size of an end of said central electrode, said method further comprising the step of fitting said end of said central electrode to said hole.

In the first to fifth aspects, if it is assumed that a distance across said spark gap is G, a minimum distance between a discharging surface of said first chip defining said spark gap and a first surface of a first welding portion in said earth electrode resulted by said step of welding and a surface of said earth electrode is L1, and a minimum distance between a discharging surface of said second chip defining said spark gap and a second surface of a second welding portion in said central electrode resulted by said step of welding and a surface of the central electrode is L2, said L1 and L2 are greater than a sum of said G and 0.3 mm.

In the first to fifth aspects, said welded chip is cut by either of discharge process, laser cutting, or wire cutting.

In the first to fifth aspects, said noble metal mainly includes Pt and further includes at least one of Ir, Rh, Ru, Pd, Ni, and W.

In the first to fifth aspects, said noble metal mainly includes Ir and further includes at least one of Pt, Rh, Ru, Pd, Ni, and W.

BRIEF DESCRIPTION OF THE DRAWINGS

The object and features of the present invention will become more readily apparent from the following detailed description taken in conjunction with the accompanying drawings in which.

The same or corresponding elements or parts are designated with like references throughout the drawings.

DETAILED DESCRIPTION OF THE INVENTION

Figure 1:
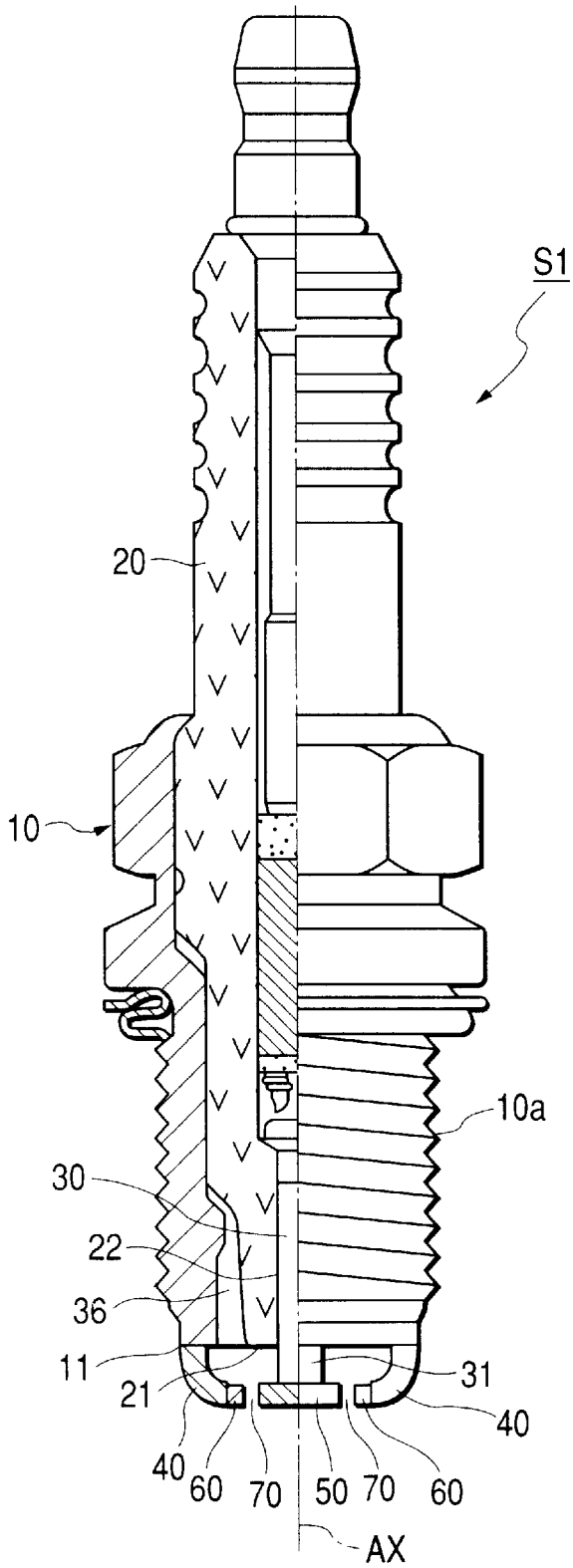
FIG. 1 is a side elevation view, partly in cross section, of a multi-electrode type of spark plug according to the invention.

The spark plug according to this embodiment is used for ignition in a vehicle engine for example. FIG. 1 shows a side elevation view, partly in cross section, of a multi-electrode type of spark plug S1 according to the invention. This spark plug S1 is screwed in a threaded hole in an engine block (not shown) with a threaded portion 10*a*.

Figure 2A:
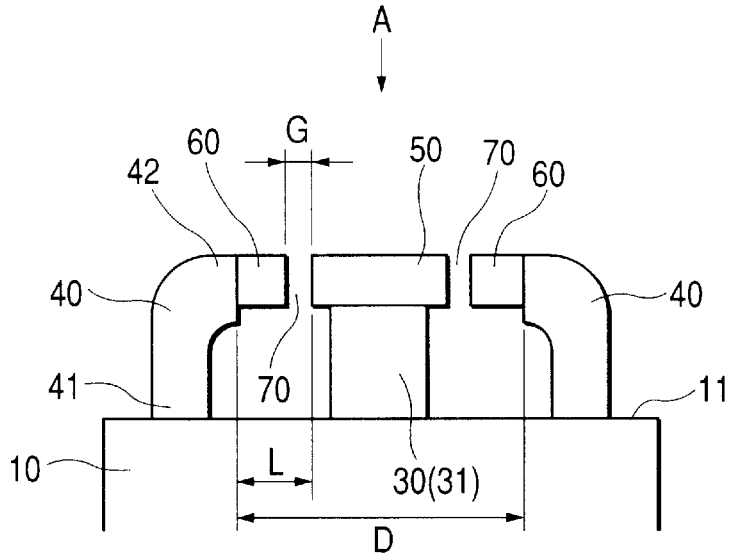
FIG. 2A is an enlarged side elevation view of a spark discharging portion according to the invention and FIG. 2B shows a plan view of the spark discharging portion.
Figure 2B:
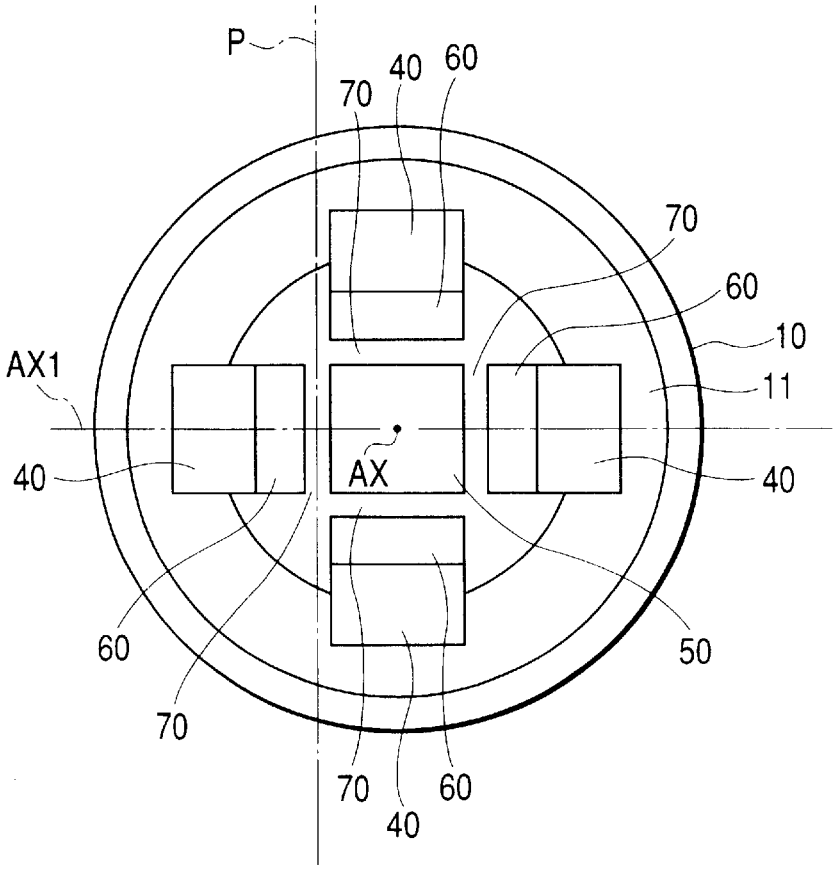

FIG. 2A shows an enlarged side elevation view in cross section of a spark discharging portion and FIG. 2B shows the plan view.

The multi-electrode type of spark plug S1 includes a tubular metal housing 10 having an inner hole 36 therein and has the thread portion 10*a* for mounting on the engine block. The housing 10 supports an insulator 20 made of alumina ceramics ($Al_2O_3$) or the like in the inner hole 36 of the housing 10. An end 21 of the insulator 20 is exposed to the space at one end 11 of the housing 10.

The insulator 20 supports the central electrode 30 in an axial hole 22 thereof, so that the housing 10 supports the central electrode 30 with insulation. An end 31 of the central electrode 30 is extended from the end 21 of the insulator 20. The central electrode 30 includes an inner material and an outer material around the inner material. The inner material includes a metallic material having superior heat conductivity such as Cu. The outer material includes a metallic material having a superior heat resistance and a superior corrosion resistance such as Ni group alloy. In this embodiment, the central electrode 30 has a cylindrical shape.

At one end 11 of the housing 10, a plurality of earth electrodes 40 are fixed to the housing 10 at their one ends 41 by means of welding or the like such that the earth electrodes surround the end 31 of the central electrode 30. These earth electrodes 40 include a Ni alloy or Fe alloy or the like. In this embodiment, each of the earth electrodes 40 has a post shape of which section is a rectangular and is bent at the intermediate portion thereof to direct the other end 42 of the earth electrode 40 opposite to one end 11 of the housing 10 toward the end 31 of the central electrode 30.

These earth electrodes 40 are arranged at the opposite positions on the circular shape of the end 11, so that the central electrode chip 50 on the center electrode 30 is arranged between these earth electrodes 40 with spark gaps 70.

At the end 31 of the central electrode 30, a central electrode chip (discharge member) 50 comprising noble metal or a noble metal alloy is bonded by laser welding or the like to an end surface of the end 31 which is perpendicular to the axis AX. On the other hand, an earth electrode chip (discharge member) 60 having a post shape consisting of noble metal or a noble metal alloy is bonded to the other end 42 of each earth electrode 40. The central electrode chip 50 and respective earth electrode chips 60 form spark gaps 70 therebetween with a distance G.

Each of the central electrode chip 50 and the earth electrode chips 60 mainly includes Pt or Ir and at least one of Rh (rhodium), Pt, Ru (ruthenium), Pd (palladium), and W (tungsten) is added thereto.

In operation, at least one of gaps 70 develops discharge which ignites the fuel-air mixture in the combustion chamber (not shown). This generates a flame core which grows and expands in the combustion chamber.

This embodiment features in providing and producing the central electrode chip 50 and the earth electrode chips 60. So, these points are mainly argued in this embodiment, and description about other basic methods of producing the spark plug S1 are omitted.

Figure 3A:
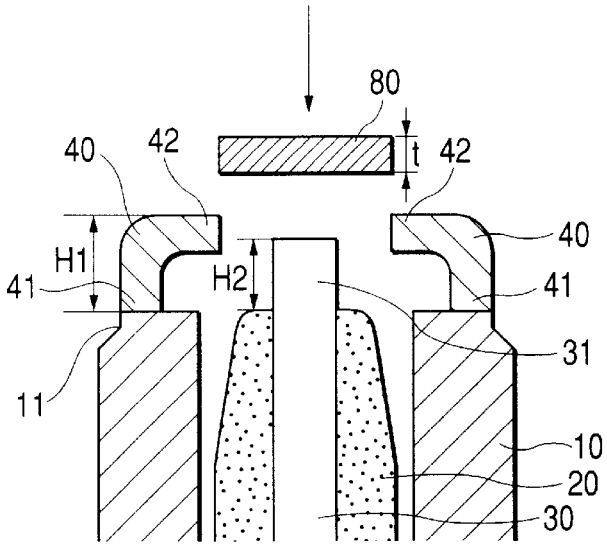
FIGS. 3A to 3C are sectional side elevation views illustrating the producing process according to a first embodiment.
Figure 3B:
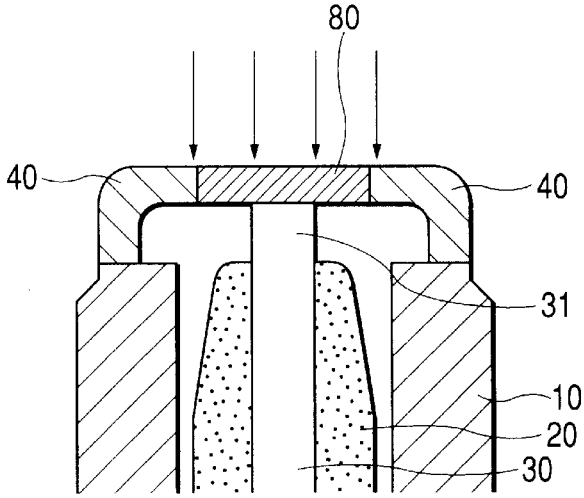
Figure 3C:
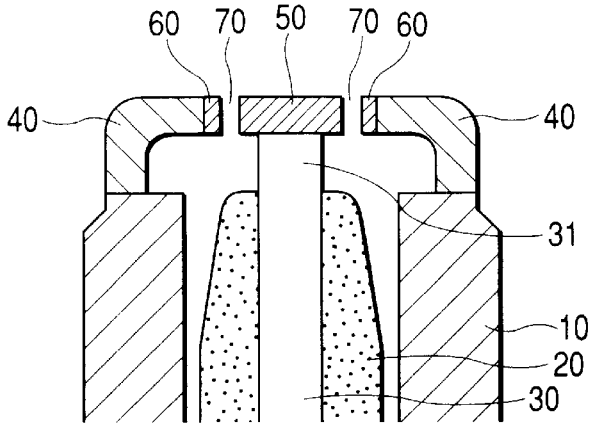
Figure 4A:
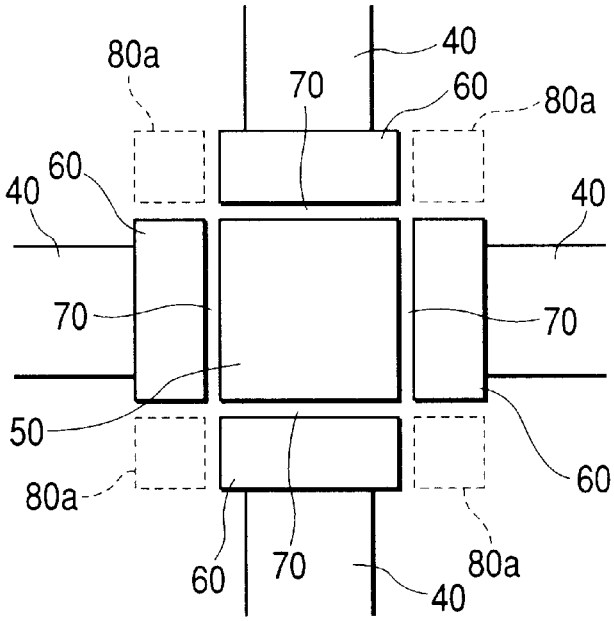
FIGS. 4A and 4B are plan views of the central electrode illustrating a cutting process according to the first embodiment.
Figure 4B:
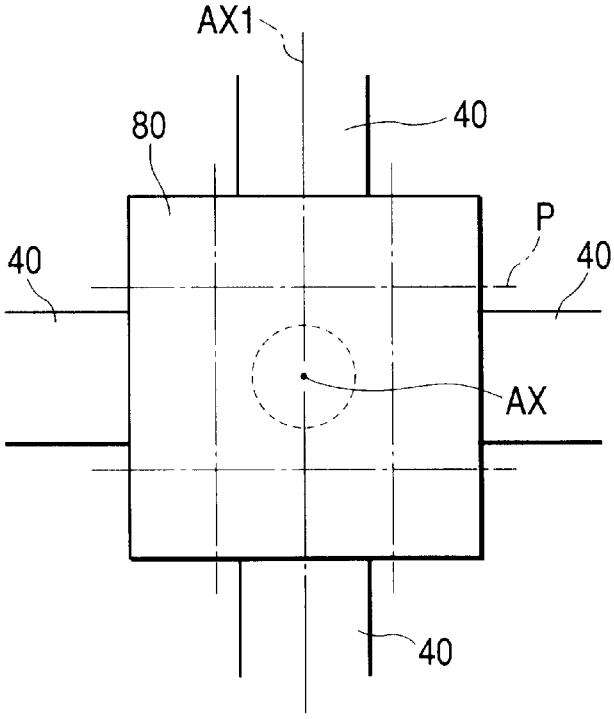

FIGS. 3A to 3C are sectional side elevation views illustrating the producing process. FIGS. 4A and 4B are plan views of the central electrode 50 illustrating a cutting process.

At first, an assembly in which the insulator 20, the central electrode 30, and the earth electrode 40 are fixed to the housing 10, is prepared, and a noble metal member 80 for the central electrode chip 50 and the earth electrode chips 60 are prepared.

The noble metal member 80 has a size defined by the other end 42 of the earth electrodes 40. That is, the noble metal member 80 is a square plate of which length of the side substantially agrees with distance D between the other ends of the earth electrodes facing to each other. The thickness t of the square plate agrees with difference between the height H1 of the other ends 42 of the earth electrodes 42 and the height H2 of the central electrode 30 (31) from the end 11 of the housing 10. The noble metal member 80 is fit into the space between the other ends 42 of the earth electrodes 40 as shown in FIG. 3A until the bottom surface of the noble metal member 80 seats on the top surface of the end 31 of the central electrode 30 as shown in FIG. 3B. Then, the noble metal member 80 contacts with the top surface of the end 31 of the central electrode 30 and the end surfaces of the other ends 42 of the earth electrodes 40.

In this condition, the noble metal member 80 is welded to other ends 42 of the earth electrodes 40 and to the end 31 of the central electrode 30 by laser welding or resistance welding or the like (chip welding process).

Next, portions of the welded noble metal member 80 are cut between the other ends 42 and the ends 31 of the central electrode 30 on the planes P in parallel to the axis AX and perpendicular to an axis AX1 of the other end 42 of the earth electrode 40 to produce the spark gaps 70 (cutting process). More specifically, the noble metal member 80 is cut along the dashed lines by either of discharge process, laser cutting, or wire cutting as shown in FIG. 4B. During this process, the width of cutting is made equal to the gap distance G by adjusting the unit for the cutting process. Accordingly, as shown in FIG. 4A, the noble metal member 80 is cut to provide the central electrode chip 50 and the earth electrode chips 60 with spark gaps 70. The corners 80*a* of the noble metal member 80 are cut off.

Figure 5A:
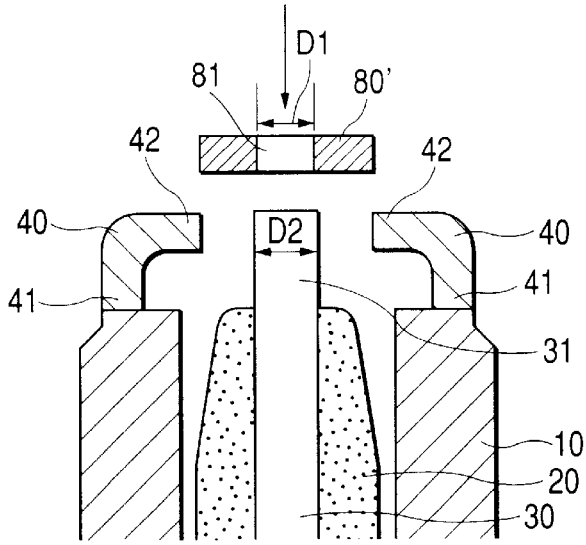
FIGS. 5A to 5C are sectional side elevation views illustrating a modified producing process according to the first embodiment.
Figure 5B:
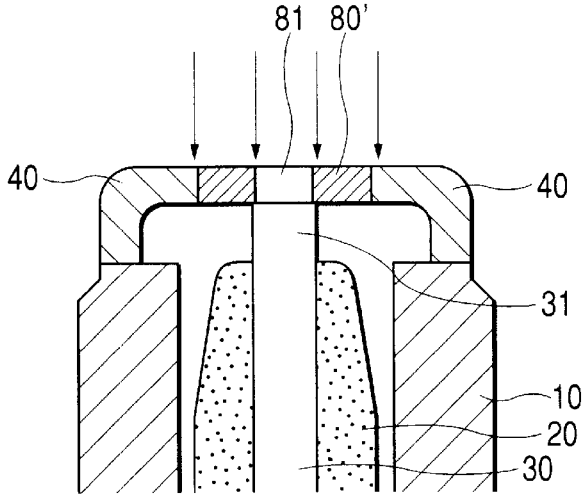
Figure 5C:
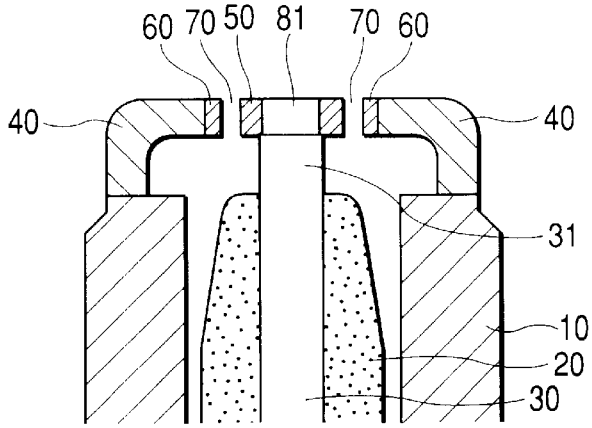

FIGS. 5A to 5C shows sectional side elevation views illustrating a modification process of producing the central electrode chip 50 and the earth electrode chips 60 in the first embodiment.

This producing process is substantially the same as that shown in FIGS. 4A to 4C. The difference is that the noble metal plate 80' has a positioning hole 81 at its center to provide accurate, easy positioning. The diameter D1 of the positioning hole 81 substantially agrees with the diameter D2 of the end 31 of the central electrode 30 for positioning. Moreover, the diameter (opening size) D1 of the positioning hole 81 may be slightly smaller than the diameter (cross-sectional area) D2 of the end 31 of the central electrode 30 to fit the end 31 to the positioning hole 81. In other words, the diameter or the opening size D1 of the positioning hole 81 is determined in accordance with the diameter (the cross-sectional area) D2 of the end 31 of the central electrode 30 in order to provide (press-) fitting. This temporarily fixes the noble metal plate 80' to the end 31 of the central electrode 30 because of the fitting of the noble metal plate 80' into the end 31 of the central electrode 30 in addition to the positioning with the positioning hole 81. The positioning hole 81 is a through hole in this embodiment. However, the positioning hole 81 may be a non-through hole. In this case, the end 31 of the central electrode 30 is inserted into the positioning hole 81 with or without fitting.

With the producing method according to the first embodiment, the number of processes in bonding, i.e., the number of processes of bonding and accompany processes can be reduced. Particularly, the number of the positioning processes of the noble metal plate 80 or 80' is reduced from five to one if the number of the earth electrode is four, so that the efficiency in producing the spark plug is increased. Moreover, the positioning is made accurate, and the dispersion in positioning can be reduced. Moreover, this process automatically provides parallelism between the central electrode chip 50 and respective earth electrode chips 60 without any special process.

This process is not limited to the multi-earth electrode type of spark plugs but is applicable to the spark plugs having a single central electrode and a single earth electrode.

As mentioned above, according to the modification in the first embodiment, the positioning hole 81 for positioning the noble metal plate 80' is formed at the center thereof, that is, a position corresponding to the end 31 of the central electrode 30. This improves the efficiency in assembling process of the noble metal plate 80'. Moreover, making the diameter of the positioning hole 80' slightly smaller than that of the end 31 of the central electrode 30 provides temporal fixing the noble metal plate 80' to the end 31 of the central electrode 30 by fitting with easiness, so that the efficiency in assembling process of the noble metal plate 80' is further improved.

Moreover, in this embodiment, it is favorable that the noble metal plate 80 or 80' is cut by a discharge process, laser cutting, or wire cutting to provide fine cutting surfaces.

In this embodiment, the distance from on of the central electrode chip 50 and the earth electrode chip 60 to the other is controlled. It is assumed that a distance from the discharge surface of one of the central electrode chip 50 and the earth electrode chip 60 to a welding portion 61 or a base material including the earth electrode 40 or the central electrode 30 is L, it is favorable that L is greater than sum of the spark gap distance G and 0.3 mm. That is, $L \geqq (G+0.3)$ mm. The inventors experimentally provide this relation.

Figure 2C:
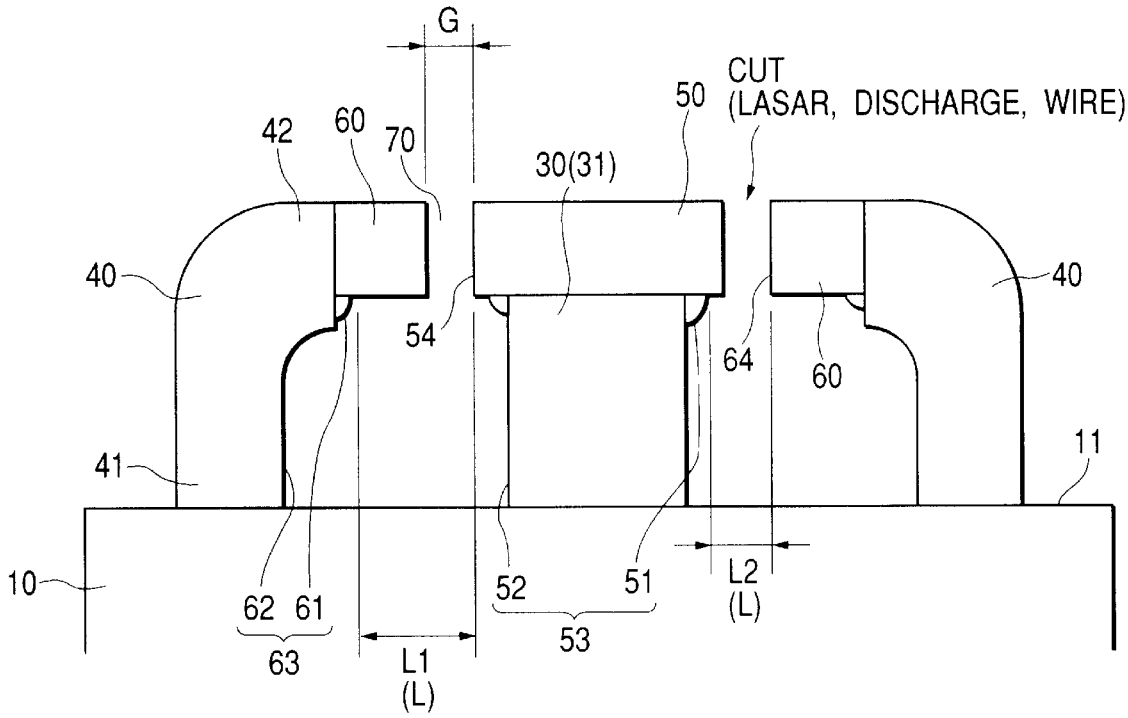
FIG. 2C is a further enlarged side elevation view of the spark discharge portion according to the invention.

FIG. 2C shows an enlarge side elevation view of the discharge portion for illustrating this relation more specifically. If it is assumed that a distance across the spark gap is G, a minimum distance between a discharging surface 54 of the central electrode chip 50 defining the spark gap 70 and a surface 63 of a first welding portion 61 in the earth electrode 40 resulted by welding and a surface 62 of the earth electrode is L1 (L), and a minimum distance between a discharging surface 64 of the earth electrode chip 60 defining the spark gap 70 and a surface 53 of a second welding portion 51 in the central electrode 30 resulted by welding and a surface 52 of the central electrode 30 is L2 (L), L1 and L2 are greater than a sum of said G and 0.3 mm.

Figure 6:
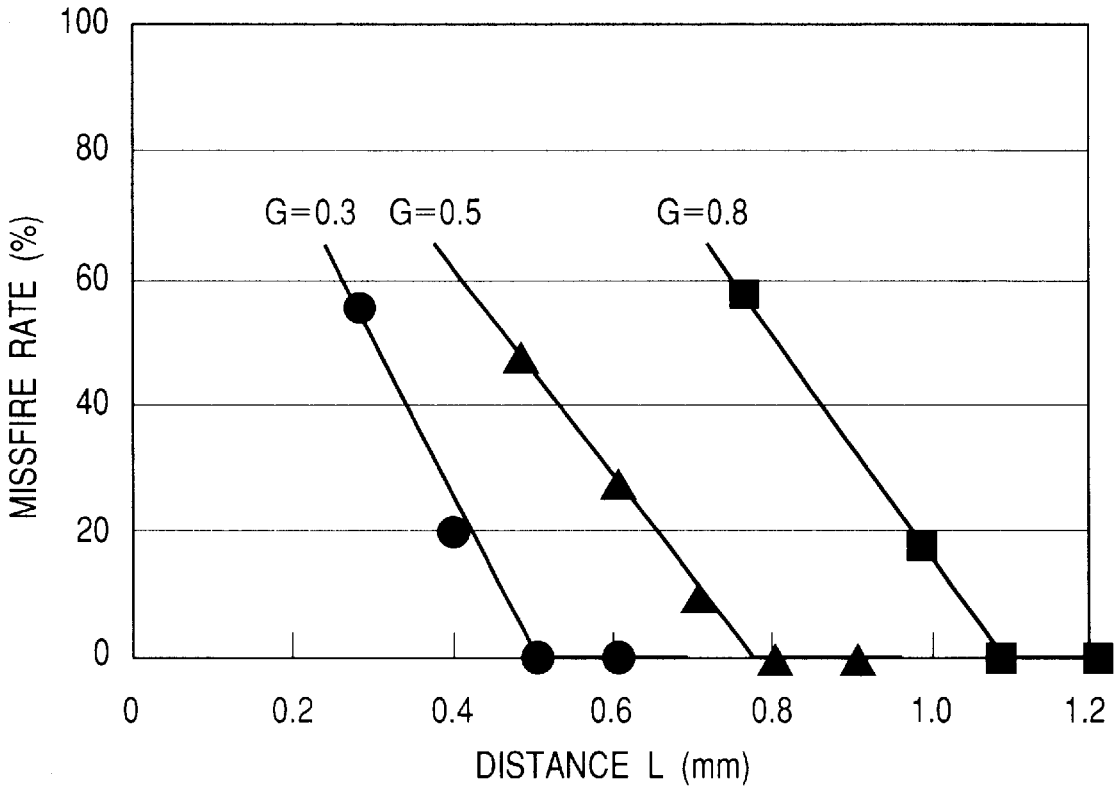
FIG. 6 is a graphical drawing showing the relation of distance L with a misfiring rate with sample spark plugs according to the invention.

FIG. 6 is a graphical drawing showing the relation of distance L with a misfiring rate with sample spark plugs. The sample spark plugs are prepared in accordance with the above-mentioned process, and the noble metal member includes an Ir alloy including 90% Ir and 10% Rh by weight (hereinafter, this alloy is referred to as Ir-10Rh). The spark gap distance G is varied from 0.3 mm to 0.8 mm to vary L, and the misfiring rate, i.e., the rate of discharge to the base material or the welding portion 50*a* or 60*a* is measured with respect to the total.

The sample spark plug S1 is fixed and ignition discharge is generated in the condition that the combustion chamber is pressed up to 0.6 MPa.

As shown in FIG. 6, in the case that the gap distance G is 0.3 mm, no misfiring occurs if the distance L is equal to or greater than 0.5 mm. That is, all discharges are made only between the central electrode chip 50 and the earth electrode chip 60 in this condition.

In the case that the gap distance G is 0.5 mm, no misfiring occurs if the distance L is equal to or greater than 0.8 mm. That is, all discharges are made only between the central electrode chip 50 and the earth electrode chip 60 in this condition.

In the case that the gap distance G is 0.8 mm, no misfiring occurs if the distance L is equal to or greater than 1.1 mm. That is, all discharges are made only between the central electrode chip 50 and the earth electrode chip 60 in this condition. Accordingly, it is favorable that L (L1 and L2) is greater than sum of the spark gap distance G and 0.3 mm. Thus, the distance L and the gap distance G are determined to prevent misfiring. This reduces burn-off in the base material or the welding portion 51 or 61. This prevents the central electrode chip 50 and the earth electrode chips 60 from being disconnected.

As mentioned above, the first embodiment provides a method of producing a spark plug including the central electrode 30 having the central electrode chip 50 including noble metal and the earth electrode 40 having the earth electrode chip 60 including the noble metal, a spark gap 70 being disposed between the central electrode chip 50 and the earth electrode chip 60, comprising the steps of: preparing the chip (noble metal member) 80 including the noble metal; welding the chip 80 to an end 31 of the central electrode 30 and to an end 42 of said earth electrode 40; and cutting the welded chip 80 to form the central electrode chip 50 and the earth electrode chip 60 and the spark gap 70.

SECOND EMBODIMENT

Figure 7A:
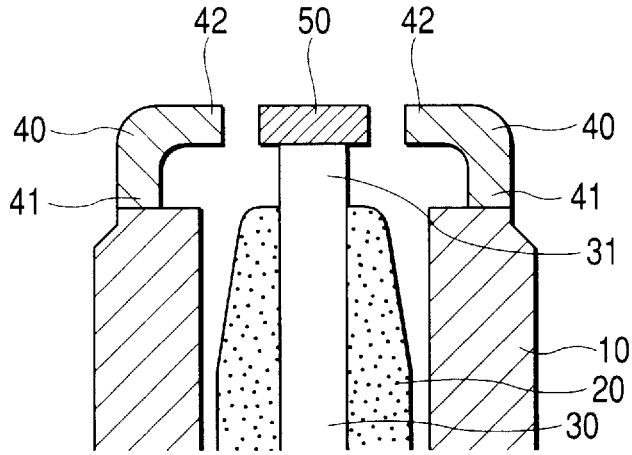
FIGS. 7A and 7B are sectional side elevation views of the discharge portion of the spark plug according to a second embodiment illustrating the producing process.
Figure 7B:
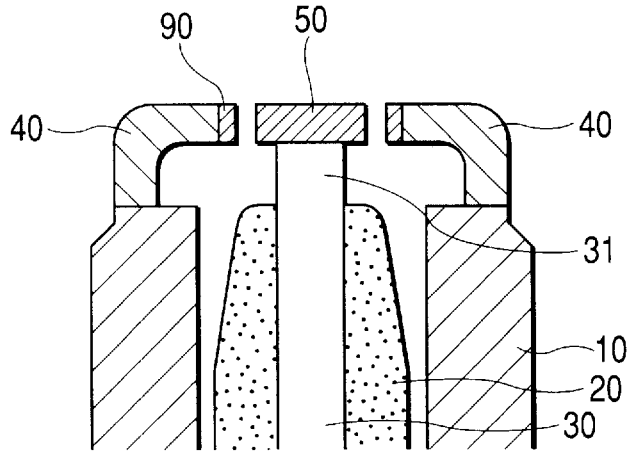
Figure 7C:
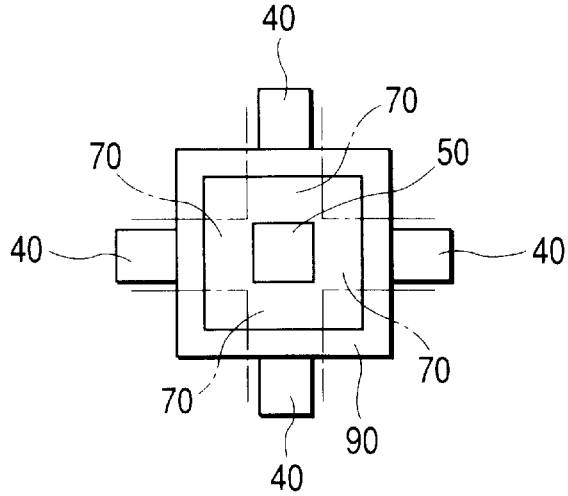
FIG. 7C is a plan view of the discharge portion of the spark plug according to the second embodiment illustrating the producing process.

The spark plug according to a second embodiment is provided substantially in the same manner as that of the first embodiment. The difference is that the central electrode chip 50 is fixed independently, and on the other hand, earth electrode chips 60 are providing by bonding a unit noble metal member 90 to the earth electrodes 40 and by cutting the noble metal member 90 to provide respective earth electrode chips 60. FIGS. 7A and 7B show sectional side elevational views of the discharge portion of the spark plug according to the second embodiment illustrating the producing process. FIG. 7C shows a plan view of the discharge portion of the spark plug according to the second embodiment illustrating the condition where the unit noble metal member 90 is welded before cutting.

This producing method is applicable only to a multi-earth electrode type of spark plug. That is, as shown in FIG. 1, a plurality of earth electrodes are provided such that the earth electrodes 40 surround the central electrode 30.

At first, the central electrode chip 50 is welded as shown in FIG. 7A. Next, the noble metal member 90 having a square frame shape including respective earth electrode chips 60 is prepared. The noble metal member 90 is welded to respective earth electrodes 40 as shown in FIGS. 7B and 7C. This provides spark gaps 70 between the central electrode chip 50 and portions of the noble metal member 90. Next, the noble metal member 90 is cut along the dashed lines in FIG. 7C such that respective earth-side chips 60 are provided.

In this process, it is also possible that after bonding the noble metal member 90 to the earth electrodes 40, the central electrode chip 50 is welded to form the spark gaps 70.

According to this embodiment, in the multi-earth electrode type of spark plug, the noble metal member 90 is welded to respective earth electrodes 40 and then, the noble metal member 90 is cut to provide the earth electrode chips 60, so that the number of process for bonding, particularly, positioning the earth electrode chips can be reduced. This improves the efficiency in producing the spark plug.

In this embodiment, the positioning hole may be formed in the central electrode chip 50 to fit it into the end 31 of the central electrode 30. Moreover, it is favorable that the relation $L \geqq (G+0.3)$ mm is established.

THIRD EMBODIMENT

The spark plug according to a third embodiment is provided substantially in the same manner as that of the first embodiment. The difference is that the earth electrodes are attached and welded after fitting the noble metal member 100 having a positioning hole 101.

FIGS. 8A to 8D are sectional side elevation views of the discharge portion of the spark plug illustrating the successive production process conditions.

Figure 8A:
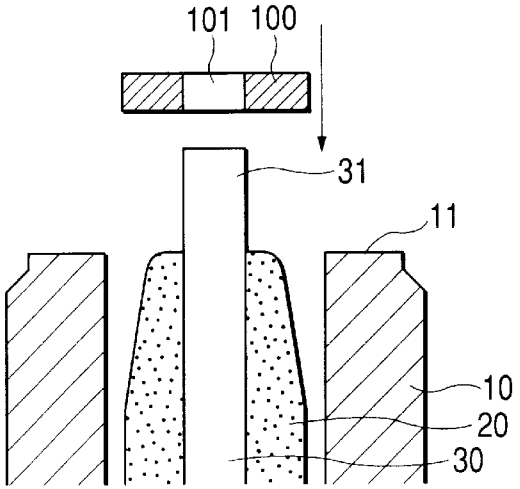
FIGS. 8A to 8D are sectional side elevation views of the discharge portion of the spark plug illustrating the successive production process conditions according to a third embodiment.

At first, as shown in FIG. 8A, the noble metal member 100 having a positioning hole 101 is prepared. The end 31 of the central electrode 30 is inserted and fitted into the positioning hole 101 to support the noble metal member 100. The noble metal member 100 has the same structure as the noble metal member 80' in the second embodiment. That is, the diameter of the positioning hole 101 is determined in accordance with the diameter of the end 31 of the central electrode 30, and its outer diameter is determined in accordance with the position and size of the earth electrodes 40.

Figure 8B:
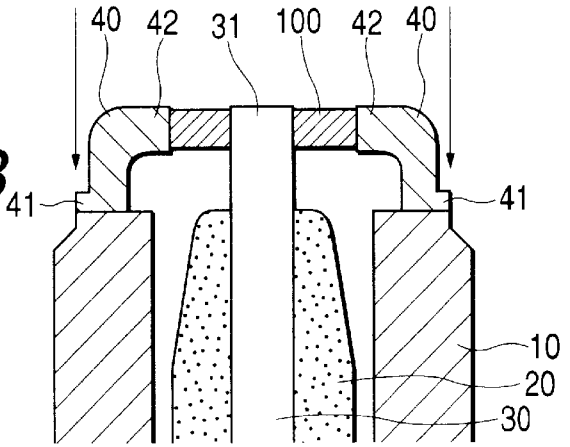

Next, as shown in FIG. 8B, the one end 41 of each earth electrode 40 is placed on the one end 11 of the housing 10 such that the surface of the other end 42 of the earth electrode 40 contacts with the noble metal member 100 to support the earth electrode 40. In this condition, one ends 41 of the earth electrodes 40 are welded to one end 11 of the housing 10.

Figure 8C:
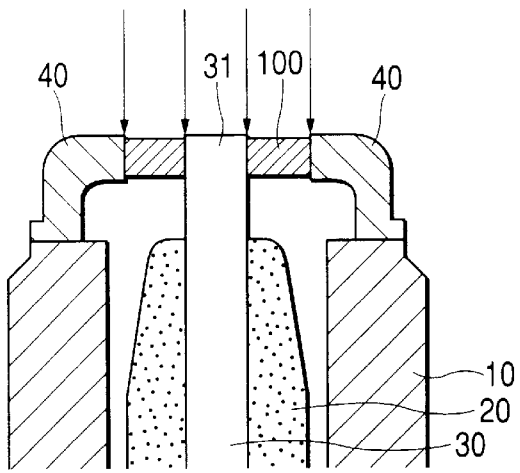

Next, as shown in FIG. 8C, the fitting portion between the end 31 of the central electrode and the noble metal member 100, and the contacting portion between the noble metal member 100 and the other ends 42 of the earth electrodes 40 are welded.

Figure 8D:
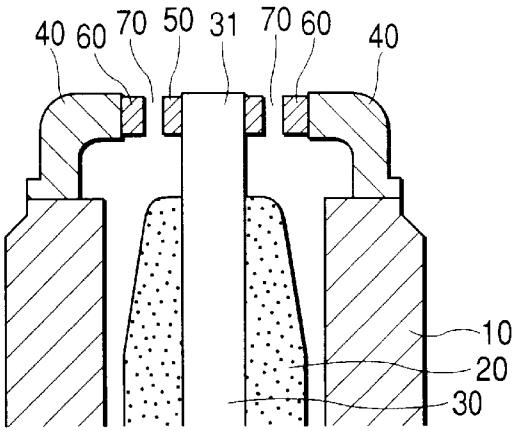

Next, the noble metal 100 is cut to provide the spark gaps 70 with chips 50 and 60 being remained as shown in FIG. 8D. This provides the spark plug S1 shown in FIG. 1 too.

According to the third embodiment, the bonding process can be effected at a high efficiency similarly to the first embodiment because the noble metal member 100 including the resultant chips 50 and 60 is welded and then, cut to provide the spark gap 70.

In this embodiment, the accuracy in producing the spark gaps 70 is favorably provided by cutting the noble metal member 100 similarly to the first embodiment. Moreover, it is favorable that the relation $L \geqq (G+0.3)$ mm is established. Furthermore, this embodiment is applicable to the spark plug having a single central electrode and a single earth electrode.

Moreover, this embodiment improves the efficiency in bonding the earth electrodes 40 because the end 31 of the central electrode 30 is fitted into the positioning hole 101 to temporarily support the noble metal member 100, and the earth electrodes 40 are placed using the noble metal member 100 as a spacer for supporting the earth electrodes 40, which makes the welding process easier and provides a stable welding result.

FOURTH EMBODIMENT

The spark plug according to a fourth embodiment is provided substantially in the same manner as that of the first embodiment. The difference is that a plurality of earth electrodes 40 are formed in a unit and is attached to the one end 11 of the housing at the same time. That is, a plurality of earth electrodes 40 are connected by a connecting member 46. For this, this embodiment is applicable only to the spark plugs having a plurality of earth electrodes.

FIGS. 9A to 9D are sectional side elevation views of the discharge portion of the spark plug illustrating the successive production process conditions according to the fourth embodiment.

Figure 9A:
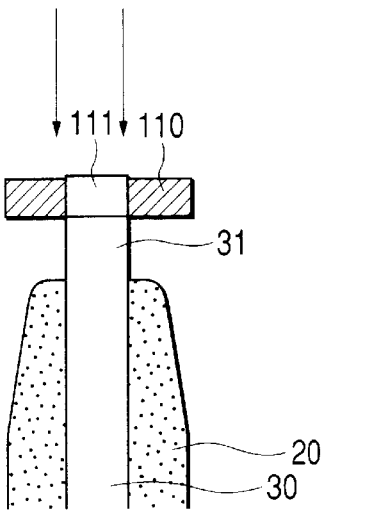
FIGS. 9A to 9D are sectional side elevation views of the discharge portion of the spark plug illustrating the successive production process conditions according to a fourth embodiment.

At first, as shown in FIG. 9A, a work including the central electrode 30 supported by the insulator 20 and the noble metal member 110 having a positioning hole 111 is prepared. The end 31 of the central electrode 30 is inserted and fitted into the positioning hole 111 to support the noble metal member 110. The noble metal member 110 has the same structure as the noble metal member 80' in the second embodiment. That is, the diameter of the positioning hole 111 is determined in accordance with the diameter of the end 31 of the central electrode 30, and its outer diameter is determined in accordance with the position and size of the earth electrodes 40 in the unit member 45. The noble metal member 110 is welded to the end 31 of the central electrode 30.

Figure 9B:
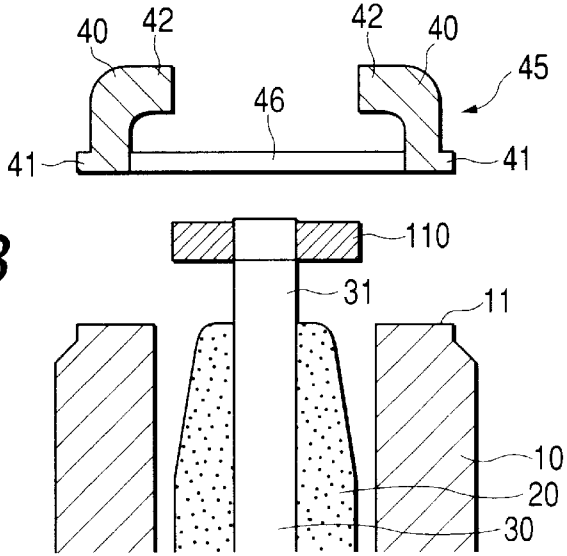

Next, as shown in FIG. 9B, the unit member 45 including a plurality of earth electrodes 40 connected to each other by the connecting member 46 is prepared. The connecting member 46 has a ring shape corresponding to the ring shape of the one end 11 of the housing 10.

The central electrode 30 to which the noble metal member 110 is bonded is assembled in the housing 10 with the insulator 20.

Figure 9C:
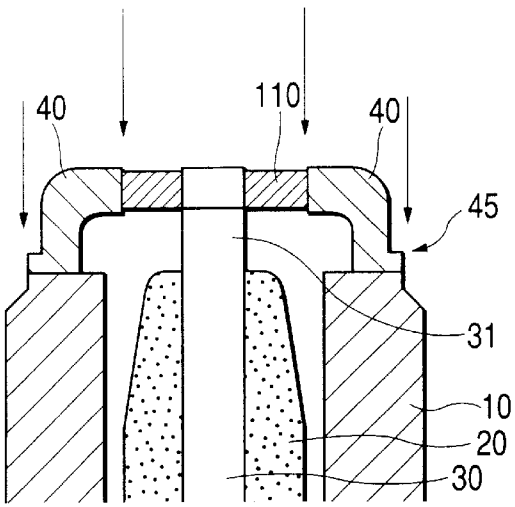

Place the unit member 45 on the one end of the housing 10 such that the other ends 42 of the earth electrodes 40 contact with the noble metal member 110 to support the earth electrodes 40 as shown in FIG. 9C.

Next the contacting portions between the noble metal member 110 and the other ends 42 of a plurality of the earth electrodes 40 and the contacting portions between one ends 41 of the respective earth electrodes 40 and the one end 11 of the housing 10 are welded as shown in FIG. 9C.

Figure 9D:
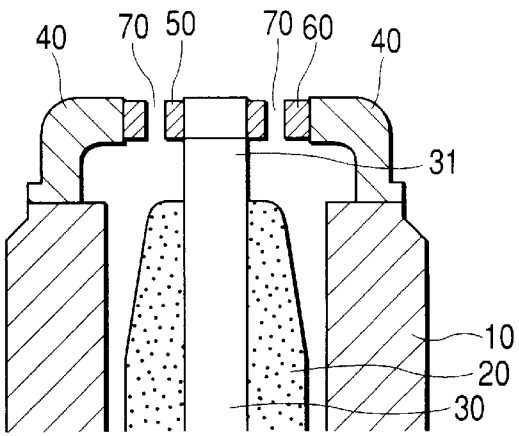

Next, as shown in FIG. 9D, the noble metal member 110 is cut to provide the spark gaps 70. This provides the spark plug S1 shown in FIG. 1 also.

According to the fourth embodiment, the bonding process can be effected at a higher efficiency than the third embodiment because the unit member 45 including a plurality of earth electrodes 30 is temporarily fixed to the housing 10 at the same time.

In this embodiment, it is also favorable that the relation $L \geqq (G+0.3)$ mm is established.

FIFTH EMBODIMENT

Figure 10A:
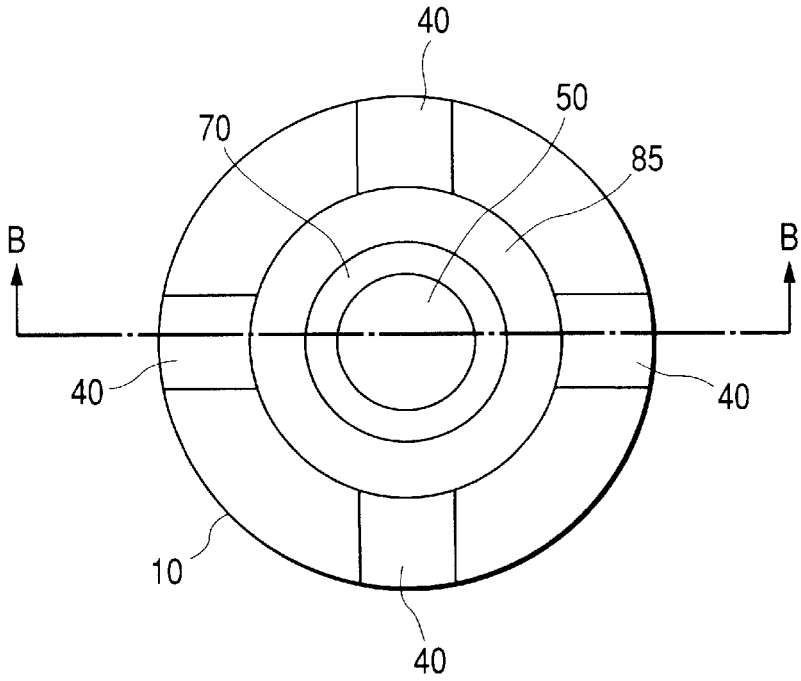
FIG. 10A is a plan view of the discharge portion of the spark plug according to a fifth embodiment.
Figure 10B:
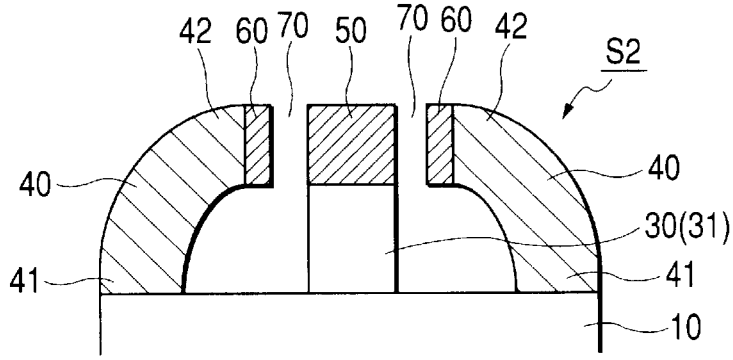
FIG. 10B is a sectional side elevation view taken on the line B—B in FIG. 10A.

FIG. 10A is a plan view of the discharge portion of the spark plug S2 according to a fifth embodiment. FIG. 10B is a sectional side elevation view taken on the line B—B in FIG. 10A. This spark plug S2 is obtained by modifying the shape of the discharge portion of the spark plug shown in FIG. 1.

The spark plug S2 includes one central electrode 30 and earth electrodes (four earth electrodes in this embodiment) are bonded such that the earth electrodes 40 surround the central electrode 30. A central electrode chip 50 is bonded to the central electrode 30, and a ring chip 85 is bonded to respective earth electrodes 40. The inner surface of the ring chip 85 faces the central electrode chip 50 to form a spark gap 70.

Figure 10C:
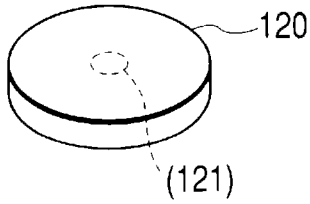
FIG. 10C is a perspective view of a circular plate chip according to the fifth embodiment.

The fifth embodiment provides a method of producing the spark plug S2 shown in FIGS. 10A and 10B. FIG. 10C is a perspective view of a noble metal member used for the spark plug S2.

At first, a noble metal member 120 having a circular plate shape is prepared. The noble metal member 120 corresponds to the central electrode chip 50, the ring chip 85, and the cut portion as the spark gap 70.

Next, the noble metal member 120 is placed on the end 31 of the central electrode 30 between the other ends 42 of the earth electrodes 40. Next, the noble metal member 120 is welded to the end 31 of the central electrode 30 and welded to respective the other ends 42 of the earth electrodes 40.

Next, the noble metal member 120 is cut to provide the central electrode chip 50 and the ring chip 85 with the spark gap 70. The above-mentioned process provides the spark plug S2 shown in FIGS. 10A and 10B.

According to the fifth embodiment, the spark plug S2 is produced by welding the noble metal member 120 having a circular plate shape to the central electrode 30 and the earth electrodes 40 and by cutting the noble metal member 120 to provide the central electrode chip 50 and the ring chip 85 with the spark gap 70, so that the number of processes for producing the spark plug S2 can be reduced. That is, the efficiency of producing the spark plug is improved.

In this embodiment, the spark gap 70 can be provided accurately due to cutting similarly to the first embodiment. Moreover, the positioning hole 121 may be provided in the noble metal member 120. Furthermore, in this embodiment, it is also favorable that the relation $L \geqq (G+0.3)$ mm is established.

Figure 10D:
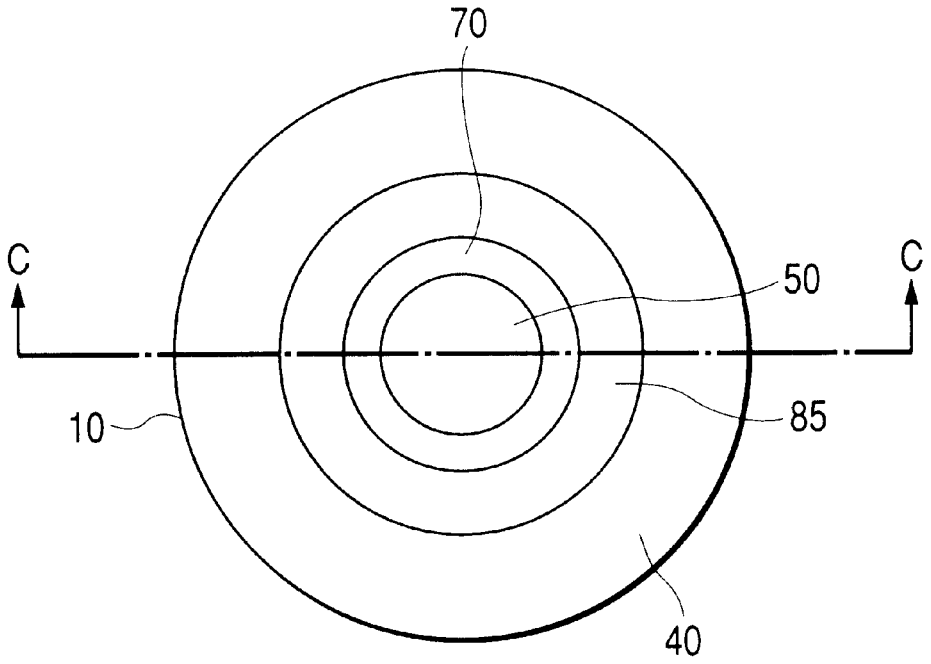
FIG. 10D is a sectional side elevation view of the discharge portion of the spark plug according to modification in the fifth embodiment.
Figure 10E:
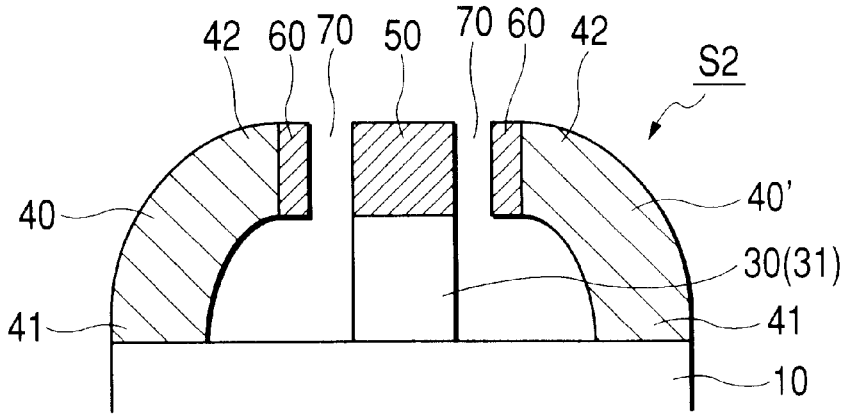
FIG. 10E is a plan view of the discharge portion according to modification in the fifth embodiment.

In FIGS. 10A and 10B, a plurality of earth electrodes 40 are provided and welded to all earth electrodes 40. However, only one earth electrode 40 having a circular shape surrounding the central electrode 30 may be used. FIGS. 10D and 10E show this example. FIG. 10D is a plan view of the discharge portion of this example. FIG. 10E is a sectional side elevation view taken on the line C—C in FIG. 10A. The earth electrode is formed to have an open dome 40'. The ring chip 85 is welded to the center edge of the open dome 40'.

Figure 11A:
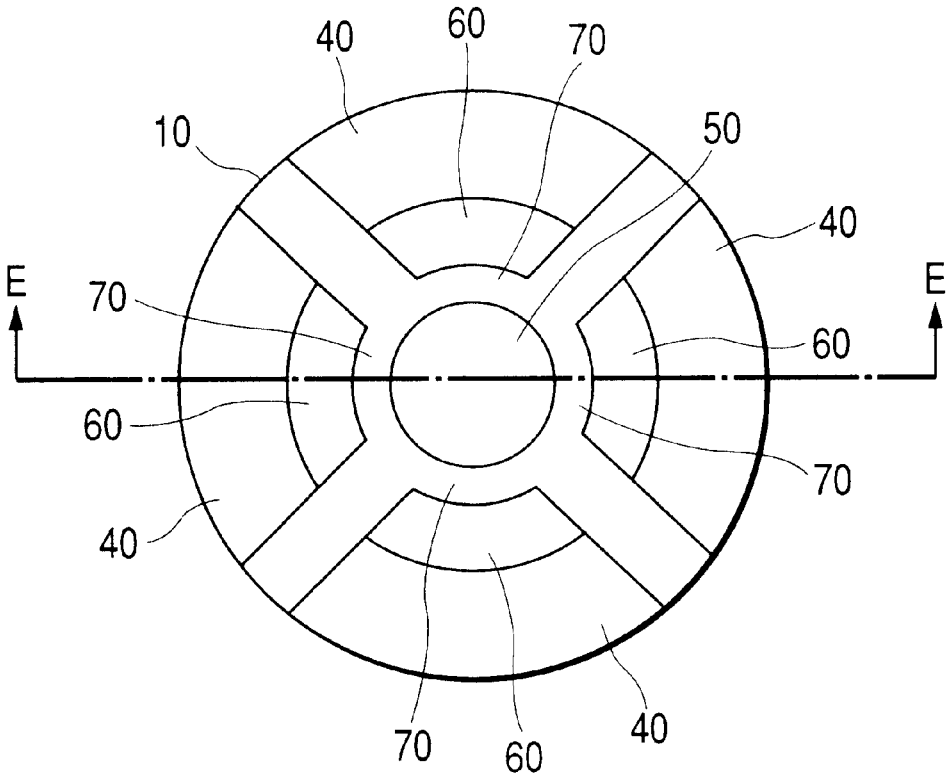
FIG. 11A is a plan view of the discharge portion of a further modification of the discharge portion shown in FIGS. 10D and 10E.
Figure 11B:
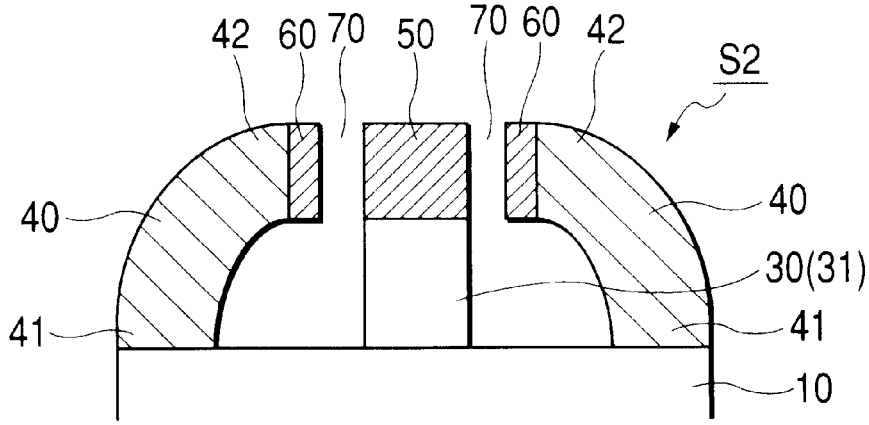
FIG. 11B is a sectional side elevation view taken on the line E—E in FIG. 11A.

FIG. 11A is a plan view of the discharge portion of modification of the discharge portion shown in FIG. 10D and 10E. FIG. 11B is a sectional side elevation view taken on the line E—E in FIG. 11A. After forming the spark plug as shown in FIGS. 10A and 10B, the ring chip 85 may cut in the radial directions as shown in FIG. 11A to provide segmented earth electrode chips 60. In other words, this embodiment is not subjected to limitation of the number of earth electrodes 40.

OTHER MODIFICATIONS

In the embodiments without limitation in the number of earth electrodes 40 out of the above-mentioned embodiments, there are modifications in accordance with the number of the earth electrodes as shown in FIGS. 12A to 12D.

Figure 12A:
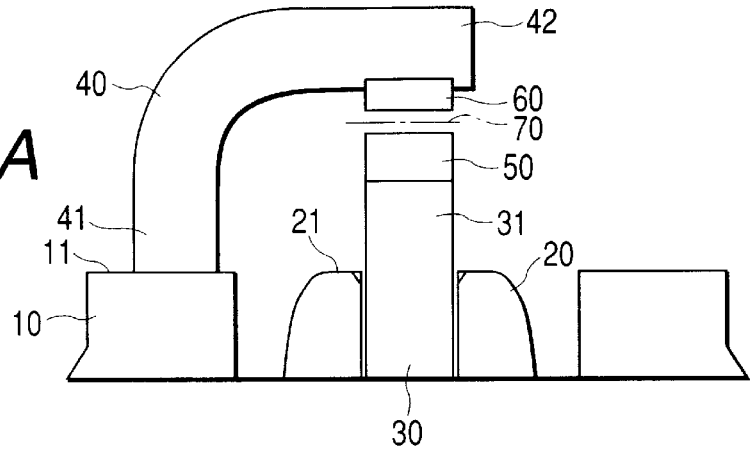
FIG. 12A is a side elevation view of a discharge portion in a modification wherein the number of the earth electrode is only one.
Figure 12B:
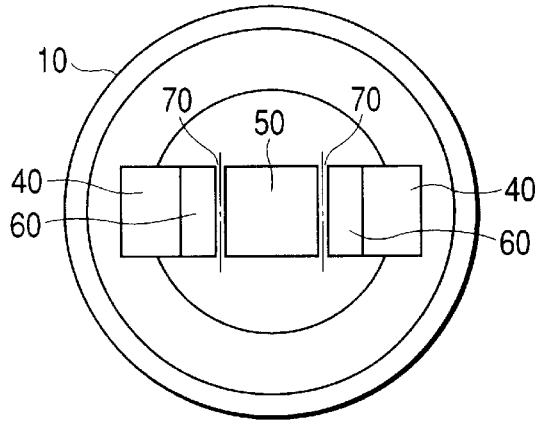
FIG. 12B is a plan view of a discharge portion in another modification.
Figure 12C:
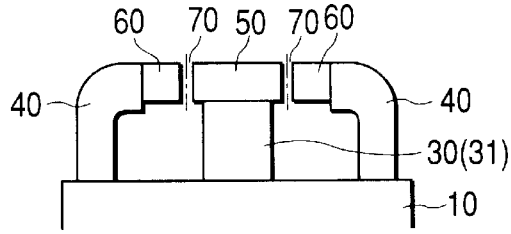
FIG. 12C is a side elevation view of the portion shown in FIG. 12B, wherein the number of the earth electrodes is two.
Figure 12D:
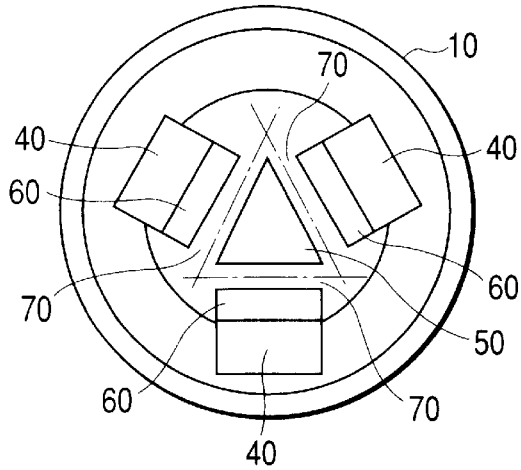
FIG. 12D is a plan view of a discharge portion of still another modification, wherein the number of the earth electrodes is three.

FIG. 12A is a side elevational view of a discharge portion in modification wherein the number of the earth electrode 40 is only one. FIG. 12B is a plan view of a discharge portion in another modification and FIG. 12C is a side elevation view of this portion, wherein the number of the earth electrodes is two. FIG. 12D is a plan view of a discharge portion of still another modification, wherein the number of the earth electrodes is three.

In each of the above-mentioned modifications, the noble metal member is welded to the central electrode 30 and to at least an earth electrode 40, and then, the noble metal member is cut at least a portion between the central electrode and at least an earth electrode to provide at least a spark gap. This is applicable to the spark plug having more than four earth electrodes also.

Figure 13A:
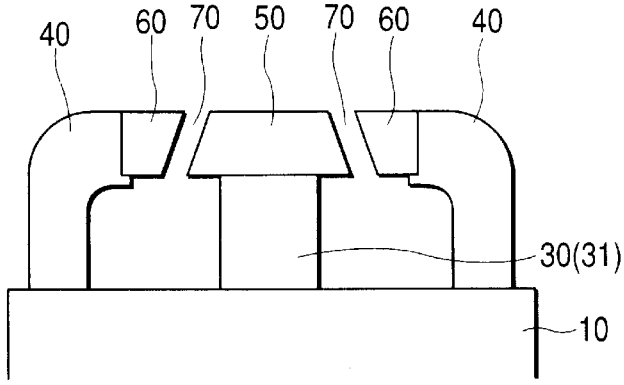
FIGS. 13A and 13B are side elevation views of the discharge portions, wherein discharge surfaces are modified.
Figure 13B:
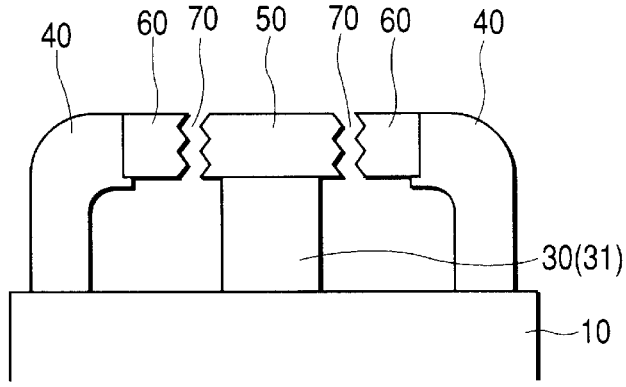

Moreover, the discharge surfaces of both chips facing to each other may have various shapes even if both discharge surfaces have parallelism therebetween. That is, the discharge surfaces may be slant surfaces as shown in FIG. 13A and may be uneven surfaces as shown in FIG. 13B.

Moreover, if the noble metal member 80 having a square top surface is cut as shown in FIG. 4A, there are useless portions at corners. However, using another noble metal member having a top surface of a cross shape (not shown) provides no useless portions.

Figure 14A:
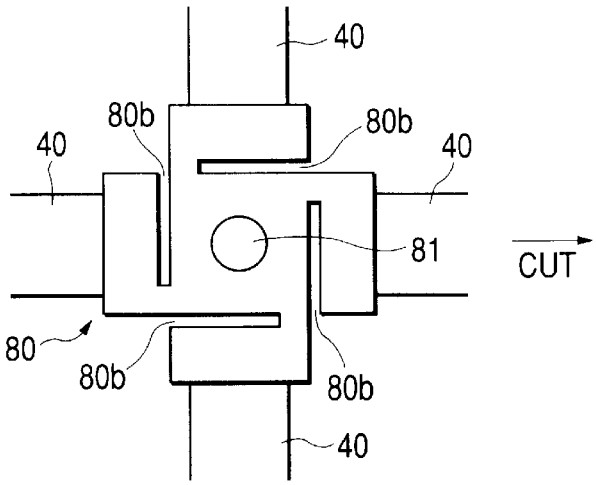
FIGS. 14A and 14B are plan views of the discharge portions, wherein the shape of the noble metal member is modified.
Figure 14B:
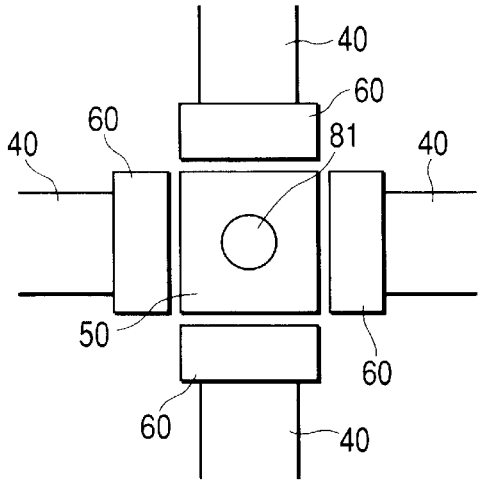

Further, the noble metal member 80 may have slits 80*b*, at the cutting places as shown in FIG. 14A to improve the efficiency in the cutting process. FIG. 14B shows the view of the discharge portion after cutting.

Figure 15A:
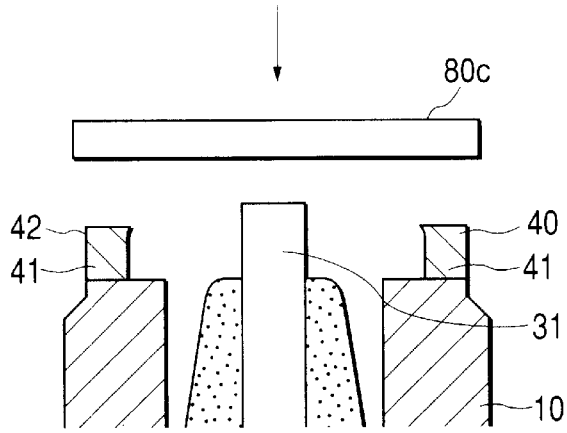
FIGS. 15A to 15C are sectional side elevational views of the discharge portion of a further modification, wherein the shape of the noble metal member is modified.
Figure 15B:
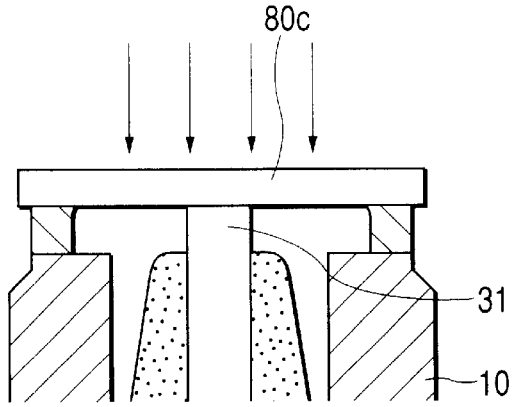
Figure 15C:
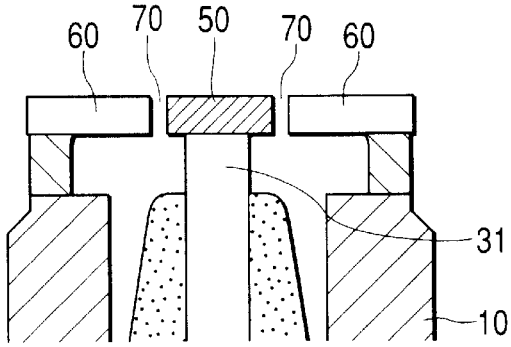
Figure 15D:
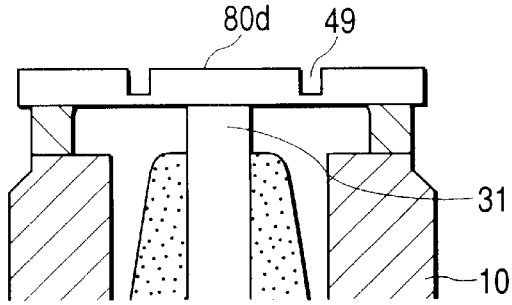
FIG. 15D is a sectional side elevation view of the discharge portion illustrating a modified noble metal member having a groove.

FIGS. 15A to 15C show a further modification. The central electrode 31 and the earth electrodes 40 are made to have the same height along the axis AX from the one end of the housing 10. A noble metal plate 80*c* having a size covering all earth electrodes 40 is placed on the end 31 of the central electrode 30 and the other ends 42 of the earth electrodes 40 as shown in FIG. 15A. Next, the noble metal plate 80*c* is welded to the central electrode 30 and to the other ends 42 of the earth electrodes 40 as shown in FIG. 15B. Next, the noble metal plate 80*c* is cut to provide the central electrode chip 50 and the earth electrode chips 60 with spark gap 70 as shown in FIG. 15C. Moreover, the noble metal member 80*d* may have grooves 49 at the cutting places to make the cutting process easy as shown in FIG. 15D.

In the second embodiment, the noble metal chip 50 may have the positioning hole.

In the above-mentioned embodiments, each welded chip 80, 80', or 120 is cut by either of discharge process, laser cutting, or wire cutting.

What is claimed is:

1. A method of producing a spark plug including a central electrode having a first chip including noble metal and an earth electrode having a second chip including said noble metal, a spark gap being disposed between said first and second chips, comprising the steps of:

preparing a chip including said noble metal;

welding said chip to an end of said central electrode and to an end of said earth electrode; and cutting said welded chip to form said first and second chips and said spark gap.

2. The method as claimed in claim 1, wherein said chip has a positioning hole, said method further comprising the step of inserting said end of said central electrode into said positioning hole before welding.

3. The method as claimed in claim 2, wherein an opening size of said hole is determined in accordance with a cross-sectional size of an end of said central electrode, said method further comprising the step of fitting said end of said central electrode to said hole.

4. The method as claimed in claim 1, wherein, L1 and L2 are greater than a sum of G and 0.3 mm where G is a distance across said spark gap, L1 is a minimum distance between a discharging surface of said first chip defining said spark gap and a first surface of a first welding portion in said earth electrode resulting from said step of welding and a surface of said earth electrode and L2 is a minimum distance between a discharging surface of said second chip defining said spark gap and a second surface of a second welding portion in said central electrode resulting from said step of welding and a surface of the central electrode.

5. The method as claimed in claim 1, wherein said welded chip is cut by either of a discharge process, laser cutting, or wire cutting.

6. The method as claimed in claim 1, wherein said noble metal mainly includes Pt and further includes at least one of Ir, Rh, Ru, Pd, Ni, and W.

7. The method as claimed in claim 1, wherein said noble metal mainly includes Ir and further includes at least one of Pt, Rh, Ru, Pd, Ni, and W.

8. The method as claimed in claim 1, wherein said chip is single and welded both to said end of said center electrode and said end of said earth electrode and then is cut at an intermediate position thereof so as to form said first and second chips and said spark gap.

9. The method as claimed in claim 1, wherein said central electrode and said earth electrode are formed to have the same height along the axis of said central electrode from one end of a housing supporting said central electrode and said earth electrode with a size covering said ends of said central electrode and said earth electrode, said method further comprising the step of placing said chip on said ends of said central electrode and said earth electrode before the step of welding, wherein said chip has a groove at a cutting place for the step of cutting, further comprising the step of forming a groove at a cutting place in step of cutting.

10. The method as claimed in claim 1, wherein said central electrode is supported by a housing and wherein said central electrode and said earth electrode are formed having the same height along the axis of said central electrode from one end of said housing supporting said central electrode, and wherein said earth electrode is of a size covering said ends of said central electrode and said earth electrode, and wherein said method further comprises the steps of:

placing said chip on said ends of said central electrode and said earth electrode before the step of welding, and forming a groove at a cutting place on said chip in during said step of cutting such that said chip has a groove at a cutting place at the time of cutting.

11. A method of producing a spark plug including a central electrode having a first chip including noble metal and a plurality of earth electrodes, each having a second chip including said noble metal, spark gaps being provided between said first chip and second chips, comprising the steps of:

preparing a chip including said noble metal;

welding said chip to an end of said central electrode and to ends of said earth electrodes; and cutting said welded chip to form said first chip and said second chips with said spark gaps.

12. The method as claimed in claim 11, wherein said chip has a positioning hole, said method further comprising the step of inserting said end of said central electrode into said positioning hole before welding.

13. The method as claimed in claim 12, wherein an opening size of said hole is determined in accordance with a cross-sectional size of an end of said central electrode, said method further comprising the step of fitting said end of said central electrode to said hole.

14. The method as claimed in claim 11, wherein, L1 and L2 are greater than a sum of G and 0.3 mm where G is a distance across said spark gap, L1 is a minimum distance between a discharging surface of said first chip defining said spark gap and a first surface of a first welding portion in each of said earth electrodes resulting from said step of welding and a surface of each of said earth electrodes, and L2 is a minimum distance between a discharging surface of each of said second chips defining said spark gap and a second surface of a second welding portion in said central electrode resulting from said step of welding and a surface of the central electrode.

15. The method as claimed in claim 11, wherein said welded chip is cut by either of a discharge process, laser cutting, or wire cutting.

16. The method as claimed in claim 11, wherein said noble metal mainly includes Pt and further includes at least one of Ir, Rh, Ru, Pd, Ni, and W.

17. The method as claimed in claim 8, wherein said noble metal mainly includes Ir and further includes at least one of Pt, Rh, Ru, Pd, Ni, and W.

18. The method as claimed in claim 11, wherein said chip is single and welded to said end of said center electrode and said end of said earth electrodes and then is cut at intermediate positions thereof so as to form said first chip and said second chips and said spark gap.

19. A method of producing a spark plug including a central electrode having a first chip including noble metal and a tubular metal housing with an earth electrode having a second chip including said noble metal, a spark gap being disposed between said first and second chips, comprising the steps of:

preparing a chip including said noble metal having a hole of which opening size corresponds to a cross-sectional size of an end of said central electrode, an outline size of said chip corresponding to distance between said end of said central electrode and an end of said earth electrode;

fitting said end of said central electrode to said hole;

placing said earth electrode on an end of said tubular metal housing such that said chip is supported by contact with said end of said earth electrode;

welding said fitted chip to said end of said central electrode and to said end of said earth electrode; and cutting said welded chip to form said first and second chips and said spark gap.

20. The method as claimed in claim 19, wherein L1 and L2 are greater than a sum of G and 0.3 mm where G is a distance across said spark gap, L1 is a minimum distance between a discharging surface of said first chip defining said spark gap and a first surface of a first welding portion in said earth electrode resulting from said step of welding and a surface of each of said earth electrodes, and L2 is a minimum distance between a discharging surface of said second chip defining said spark gap and a second surface of a second welding portion in said central electrode resulting from said step of welding and a surface of the central electrode.

21. The method as claimed in claim 19, wherein said welded chip is cut by either of discharge process, laser cutting, or wire cutting.

22. The method as claimed in claim 19, wherein said noble metal mainly includes Pt and further includes at least one of Ir, Rh, Ru, Pd, Ni, and W.

23. The method as claimed in claim 19, wherein said noble metal mainly includes Ir and further includes at least one of Pt, Rh, Ru, Pd, Ni, and W.

24. A method of producing a spark plug including a central electrode having a first chip including noble metal and a tubular metal housing having a plurality of earth electrodes, each earth electrode having a second chip including said noble metal, spark gaps being provided between said first chip and second chips, comprising the steps of:

preparing a chip including said noble metal;

welding said chip to an end of said central electrode;

placing a unit member including a plurality of said earth electrodes on one end of said housing such that ends of said earth electrodes are supported by contact with a surface of said chip to position said unit member;

welding said unit member to said housing;

welding ends of said earth electrodes to said chip; and cutting said welded chip to form said first chip and said second chips with said spark gaps.

25. The method as claimed in claim 24, wherein said chip has a positioning hole, said method further comprising the step of inserting said end of said central electrode into said positioning hole before welding.

26. The method as claimed in claim 25, wherein an opening size of said hole is determined in accordance with a cross-sectional size of an end of said central electrode, said method further comprising the step of fitting said end of said central electrode to said hole.

27. The method as claimed in claim 24, wherein, L1 and L2 are greater than a sum of G and 0.3 mm where G is a distance across said spark gap, L1 is a minimum distance between a discharging surface of said first chip defining said spark gap and a first surface of a first welding portion in each of said earth electrodes resulting from said step of welding and a surface 62 of each of said earth electrodes, and a minimum distance between a discharging surface of each of said second chips defining said spark gap and a second surface of a second welding portion in said central electrode resulting from said step of welding and a surface of the central electrode.

28. The method as claimed in claim 24, wherein said welded chip is cut by either of discharge process, laser cutting, or wire cutting.

29. The method as claimed in claim 24, wherein said noble metal mainly includes Pt and further includes at least one of Ir, Rh, Ru, Pd, Ni, and W.

30. The method as claimed in claim 24, wherein said noble metal mainly includes Ir and further includes at least one of Pt, Rh, Ru, Pd, Ni, and W.

31. A method of producing a spark plug including a central electrode having a first chip including noble metal and having a circular plate shape and an earth electrode having a second chip including said noble metal and having a ring shape surrounding said first chip, a spark gap being provided between said first and second chips, comprising the steps of:

preparing a circular plate chip including said noble metal;

welding said circular plate chip to an end of said central electrode and to an end of said earth electrode; and cutting said welded chip to form said first and second chips and said spark gap.

32. The method as claimed in claim 31, wherein said earth electrode is formed to have one open dome.

33. The method as claimed in claim 31, wherein said earth electrode is formed to have a plurality of earth electrodes which are arranged to surround said first chip.

34. The method as claimed in claim 31, wherein said chip has a positioning hole, said method further comprising the step of inserting said end of said central electrode into said positioning hole before welding.

35. The method as claimed in claim 34, wherein an opening size of said hole is determined in accordance with a cross-sectional size of an end of said central electrode, said method further comprising the step of press-fitting said end of said central electrode to said hole.

36. The method as claimed in claim 31, wherein L1 and L2 are greater than a sum of G and 0.3 mm where G is a distance across said spark gap, L1 is a minimum distance between a discharging surface of said first chip defining said spark gap and a first surface of a first welding portion in said earth electrodes resulting from said step of welding and a surface 62 of said earth electrodes, and L2 is a minimum distance between a discharging surface of said second chip defining said spark gap and a second surface of a second welding portion in said central electrode resulting from said step of welding and a surface of the central electrode.

37. The method as claimed in claim 31, wherein said welded chip is cut by either of discharge process, laser cutting, or wire cutting.

38. The method as claimed in claim 31, wherein said noble metal mainly includes Pt and further includes at least one of Ir, Rh, Ru, Pd, Ni, and W.

39. The method as claimed in claim 31, wherein said noble metal mainly includes Ir and further includes at least one of Pt, Rh, Ru, Pd, Ni, and W.

40. The method as claimed in claim 31, wherein said chip is single and welded both to said end of said center electrode and said end of said earth electrodes and then is cut at an intermediate position thereof so as to form said first and second chips and said spark gap.

* * * * *